US006241043B1

(12) United States Patent
Goertz

(10) Patent No.: US 6,241,043 B1
(45) Date of Patent: Jun. 5, 2001

(54) MUFFLER INSERT AND PROCESS FOR THE PRODUCTION THEREOF

(76) Inventor: Johannes Ulrich Goertz, Krüsshütt 27, D-41334, Nettetal (DE)

( * ) Notice: Subject to any disclaimer, the term of this patent is extended or adjusted under 35 U.S.C. 154(b) by 0 days.

(21) Appl. No.: 09/303,255

(22) Filed: Apr. 30, 1999

(30) Foreign Application Priority Data

May 1, 1998 (DE) ..... 298 07 858 U

(51) Int. Cl.[7] ..... F01N 1/10

(52) U.S. Cl. ..... 181/252; 181/282; 181/256; 181/258; 181/222; 29/890.08

(58) Field of Search ..... 181/282, 252, 181/256, 258, 222; 29/890.08

(56) References Cited

U.S. PATENT DOCUMENTS

| | | | | |
|---|---|---|---|---|
| 1,627,324 | * | 5/1927 | Green . | |
| 4,316,523 | * | 2/1982 | Boretti | 181/226 |
| 4,947,957 | * | 8/1990 | Cullen et al. | 181/258 |
| 5,007,499 | * | 4/1991 | Ebbing et al. | 181/258 |
| 5,593,745 | | 1/1997 | Haselkorn et al. . | |
| 5,670,756 | * | 9/1997 | Ohtaka et al. | 181/256 |
| 5,718,045 | * | 2/1998 | Tsukahara et al. | 29/890.08 |
| 5,777,947 | * | 7/1998 | Ahuja | 367/1 |
| 6,053,276 | * | 4/2000 | D'Amico, Jr. et al. | 181/243 |

FOREIGN PATENT DOCUMENTS

| | | |
|---|---|---|
| 28 27 237 A1 | 2/1979 | (DE) . |
| 3144193 A1 | 5/1983 | (DE) . |
| 3205186 A1 | 8/1983 | (DE) . |
| 3642714 A1 | 6/1988 | (DE) . |
| 89 10 785 U1 | 1/1990 | (DE) . |
| 3827863 A1 | 2/1990 | (DE) . |
| 91 01 926 U1 | 7/1991 | (DE) . |
| 19506529 A1 | 8/1995 | (DE) . |
| 0 692 616 A1 | 1/1996 | (EP) . |

* cited by examiner

*Primary Examiner*—Robert E. Nappi
*Assistant Examiner*—Edgardo San Martin
(74) *Attorney, Agent, or Firm*—Cantor Colburn LLP

(57) ABSTRACT

In order to create a process for producing muffler inserts as well as novel muffler inserts, which are most optimally adaptable in size and shape to the interior space of the muffler housing to be filled, by simple means, and which also can be produced economically and have improved effect, a process is proposed for producing muffler inserts which operate entirely or partially according to the absorption principle, whereby a predetermined amount of a loose bundle of individual elements of a suitable sound-absorbing material is formed, the loose bundle is shaped roughly in an assembly shaping unit corresponding to the intended shape of the muffler insert, and whereby the loose bundle is fixed into a shaped composite in the shape corresponding to the assembly shaping unit, in such a way that the fixed shape can be handled without individual elements loosening until assembly for the specified uses of the muffler insert; however during the specific use as a muffler insert the fixing is at least partially released.

18 Claims, 2 Drawing Sheets

MUFFLER INSERT AND PROCESS FOR THE PRODUCTION THEREOF

TECHNICAL FIELD OF THE INVENTION

The present invention concerns a process for the production of muffler inserts for mufflers, which entirely or partially operate according to the absorption principle, as well as muffler inserts produced according to the process.

BACKGROUND OF THE INVENTION

Muffler inserts of this type are located in the mufflers of the exhaust units of combustion engines for noise damping. Usually the mufflers are cup-like structures, through which the exhaust pipe is guided, and in which sound can spread out and be lost in the damping material.

The sound absorbing material preferably is a so-called porous sound absorbing material, therefore a material without structured arrangements of cavities and material process.

Such materials have to be inserted into the muffler cups. It is well known how to release these materials from a container as a kind of refilling and to insert them into muffler cups. This has a number of disadvantages, since it does not permit the amount to be inserted to be determined exactly and provide a uniformly loose amount. In addition it has been shown that the service life of such materials is extremely short.

In DE G 89 10 785 it was proposed that a cylindrical muffler insert element be made out of inner and outer screen pipe with a filled intermediate space. This is expensive to produce, transport, store, and assemble. In addition no exact seating in the muffler cup is produced, so that the effect is not satisfactory.

From DE 36 42 714 A1 it is known how to push insulation from shaped fiber parts in the form of a flexible tube onto exhaust lines. In this case several metal film and fiberglass hose layers are combined into a shaped part.

DE 31 44 193 discloses a sound-absorbing body of a mineral fiber tube shell. In the first place this is a matter of a bonded material, therefore a shaped piece bonded with a binding agent, the effect of which is unsatisfactory and the service life of which is short. In addition, the production and assembly are expensive and the shaped part is expensive.

From DE G 91 01 926 it is known how to prepare a damping material shaped part in the form of a cushion. In this case the long sides are sewed up, which produces a material shrinkage. A cavity, which leads to the formation of heat centers, arises in the case of locating the cushion in a muffler housing. These lead to premature sealing of the muffler insert.

Altogether the muffler inserts known from the prior art have the disadvantage that they are either poorly damping, rigid and solid bodies, or in the case of the design as light accumulations at the time of production, the assembly and the use are problematic. Altogether the inserts known from the prior art lead to a frequent need for replacement and thus are uneconomical.

SUMMARY OF THE INVENTION

On the basis of the prior art described above, the object of the present invention is to prepare a process for producing muffler inserts as well as novel muffler inserts, which are most optimally adaptable in size and shape to the interior space of the muffler housing to be filled, by simple means, and which also can be produced economically and have improved effect.

With respect to the process in accordance with the invention, the technical solution is achieved by a process for producing muffler inserts, which operate entirely or partially according to the absorption principle, a predetermined amount of a loose bundle of individual elements of a suitable sound absorbing material being formed, the loose bundle being shaped roughly in an assembly shaping unit corresponding to the intended form of the muffler insert, and the loose bundle being fixed in the shape corresponding to the assembly shaping unit to a shaped composite, such that the fixed shape can be handled without individual elements loosening until assembly for the specified uses of the muffler insert, however during the specific use as a muffler insert the fixing is at least partially released.

In accordance with the process invented, a temporary shaped composite is produced, which concludes the production process, and for its part it is well storable, transportable, and assemblable. In the specified use in a muffler housing the shaped composite is partially released, so that an optimal filling of the inner space of the muffler housing to be filled is performed. In addition the sound damping nature of the loose bundle is utilized optimally.

Advantageously the shaped composite is released by the action of high temperatures. The usual operating condition in muffler housings is characterized by very high temperatures. These can lead to the release of adhesive bonds, seams or the like, and thus cause the at least partial release of the shaped composite.

The loose bundle is available in the form of a loose accumulation, without a binding agent. Advantageously it is pile of fiber portions of textured E-glass-yarn. Mineral wool or similar materials also can be used. Mixtures of different materials also are usable. The forming of a predetermined amount can take place by weighing.

Optimal amounts can be determined depending on the desired application, therefore muffler housing types. These can be defined by weight or other measurable physical properties of the material. The loose bundle then is molded in an assembly shaping unit and fixed as a shaped composite. The shaped composite can be formed by sewing, covering, or the like. In accordance with one proposal of the invention strips can be cut out of flat materials from which again a covering for the loose accumulation is produced. Thus the material can be inserted into the covering and this sewn together. Also the material can be pushed into the covering after this is made. Finally the covering is closed and/or shaped. It can be shaped e.g. in the form of a hose, as a result of forming a tube out of the filled covering and sewing the edges. The tube shaping can be supported by the fact that the mat formed from the covering and covered sound absorbing material is wound around a mandrel. The free edges then are sewn together. It has proved to be particularly advantageous to form a sewable projection on one edge. For example, this projection can be glued flush with the outside of the mat after the winding. In order to support the desired outer shape of the tube, the shaping unit wound around the mandrel can be inserted into a tube. This tube shape preferably arises as a result of folding two tube halves together. After drying the glue the molded element thus formed has the desired final form. Thus it can be removed from the mandrel and easily transported and finally mounted. The action of heat in the insert reloosens the glue seam again and produces an optimum filling of the muffler housing. In addition, further seams can be opened, for example by the action of heat, so that an even better filling and an improved damping effect can be achieved.

The covering can consist, for example, of texturized E-glass-yarn, alternative materials, or mixtures. Also different strips of different materials can be combined depending on the application.

The strips are formed by cutting, stamping, punching, or also by casting in the case of plastic processing. Commercial adhesives can be used as adhesives.

Nets, sewn pieces and the like also can be used for forming the shaped composite. Wire mesh also can be used. It is important that the materials used be non-combustible. Also they are to be heat resistant, therefore not melt, if they are not to be loosened intentionally, such as, for example, welded or glued places. Furthermore they should have corresponding heat insulation properties, in order e.g. to protect e.g. carbon housings, or protect stainless steel from discoloring. In addition only sound absorption or sound permeability properties are relevant.

Novel muffler inserts, which have improved sound damping properties, and can be produced economically, assembled easily, and have a long service life, are produced with the invention according to new processes.

With respect to the device the object of the invention is solved by means of a new muffler insert, made out of a predetermined amount of a loose bundle of individual elements of a suitable sound-absorbing material, which is shaped and fixed in shape, whereby the fixing can be at least partially released in the specified use of the muffler insert.

BRIEF DESCRIPTION OF THE DRAWINGS

Further advantages and features of the invention follow from the following description by means of the figures. Here.

DESCRIPTION OF THE PREFERRED EMBODIMENT

Figure 1:
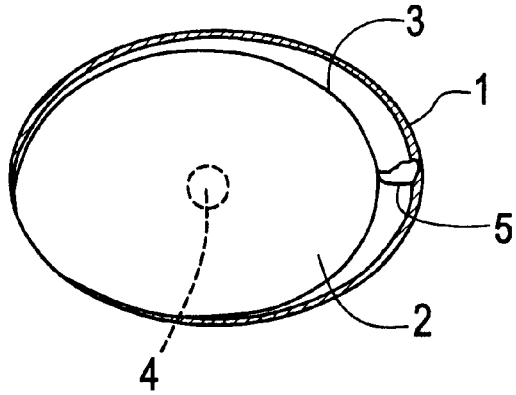
FIG. 1 shows a schematic cross-section of a muffler housing with an inserted muffler insert in the assembly condition.

A seam also is formed if a tubular shape is made out a cushion filled with a sound-damping material by winding and edge-sewing. FIG. 1 shows a cross-section of a muffler housing 1 in which a damping material 2 in a covering 3, surrounding a screen pipe 4, is shown. The covering is sewn and shows the seam 5. In this assembly condition there are cavities and thus possibilities for heat centers with the consequence of a short service life or, as the case may be, a premature sealing.

Figure 2:
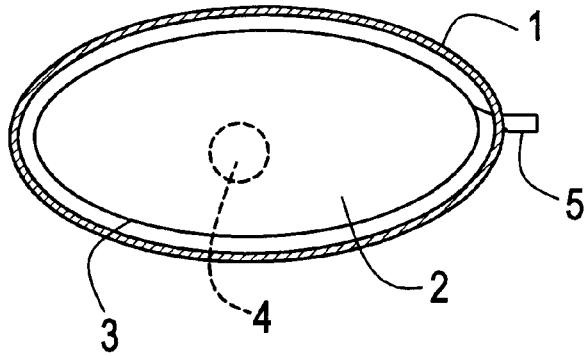
FIG. 2 shows an alternative oversized embodiment of FIG. 1

If, as is indicated in FIG. 2, the muffler insert is oversized, it is difficult to assemble the damping material 2 located in the covering 3 around the screen pipe 4 by insertion into the muffler housing 1.

Figure 3:
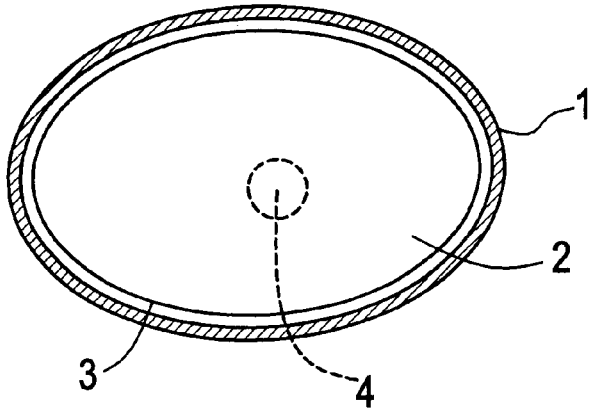
FIG. 3 shows a specific embodiment of the invention after complete assembly.

However, if a molded element as shown in FIG. 1, is used, in the case of which the fixing, therefore, for example, the seam 5, is at least partially eliminated, the muffler insert can expand completely filling the housing 1, and the condition shown in FIG. 3 results.

Figure 4:
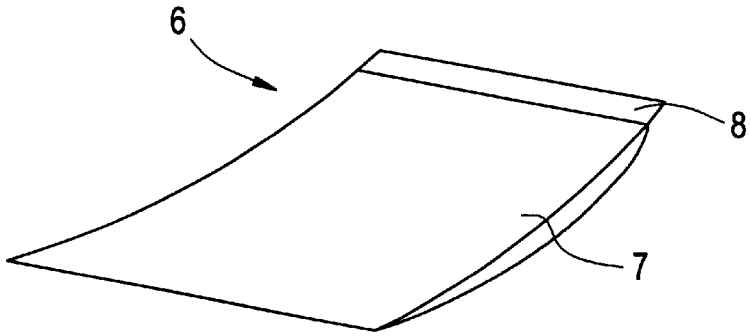
FIG. 4 shows a specific embodiment for a muffler insert in accordance with the invention.

FIG. 4 shows an embodiment for a muffler insert in an intermediate state. The muffler insert 6 has a mat shape and consists of a filled area 7, in which a loose bundle of individual elements for a suitable sound-absorbing material, for example fibers of textures E-glass-yarn, are located. There is a piece 8 projecting through them on one of the long edges.

Figure 5:
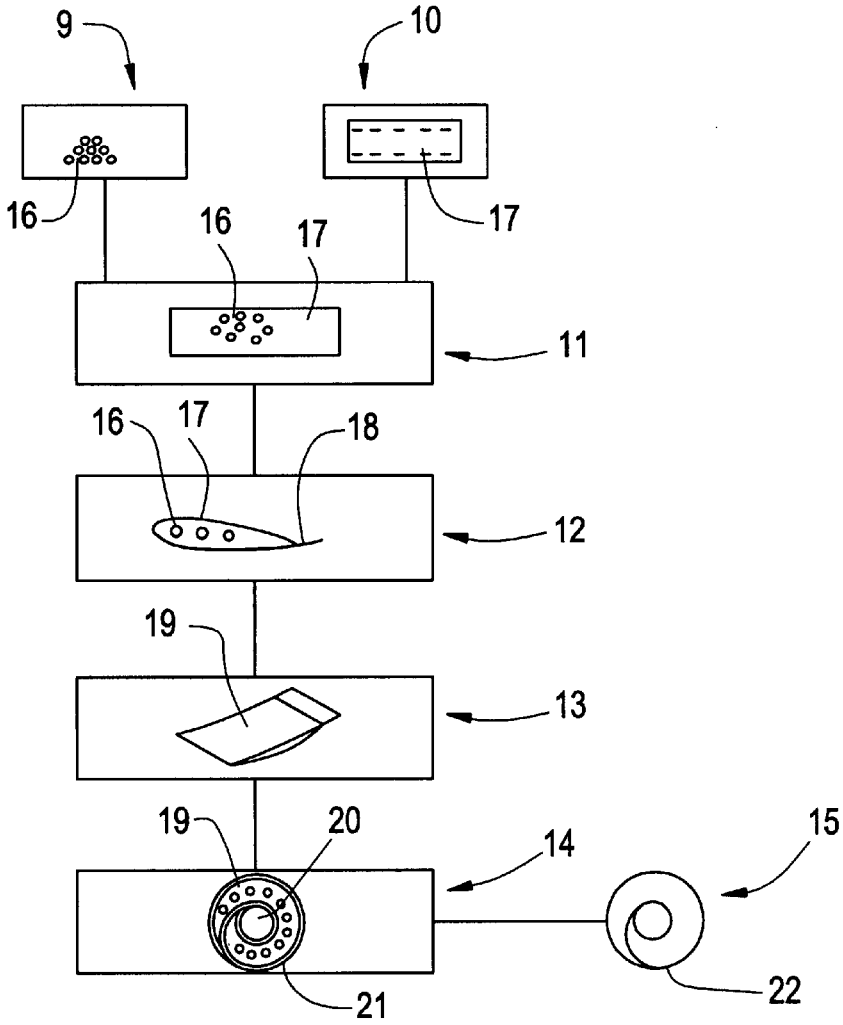
FIG. 5 shows a flow diagram representation of the production process.

In order to produce such an element, and for further processing, in accordance with FIG. 5 a predetermined amount of a loose bundle 16 of sound absorbing material next is formed in a first section. In a parallel step 10, a strip 17 is made out of a covering material. The strip 17 is only one strip in the specific embodiment shown, however it can consist of a number of individual elements. For example, a fabric of textured E-glass-yarn can be used as covering material.

In a process step 11 then the loose bundle 16 is spread on the strip 17 and a strip with a projection 18 is formed in process step 12 by folding the covering 17. Now in process step 13, which corresponds to the element shown in FIG. 4, an element 19 with a projection is formed by sewing the edges together.

Then the mat 19 is wound around a winding mandrel 20 and embedded into a shape 21 formed by two pipe halves capable of folding around one another. Gluing the projection 18 with the covering material produces a cylindrical muffler insert 22 in accordance with process step 15. As an alternative to this the muffler insert 22 also can be made conical. This has a cylindrical or tubular shape and can easily be mounted in a corresponding muffler housing. The action of heat releases the adhesion of the projection 18 with the covering material, and the mat expands as desired and optimally in the interior of the housing.

The embodiments described serve for explanation and are not limiting. In particular, the material, shapes, and the like can be varied.

What is claimed is:

1. A process for producing muffler inserts for mufflers, which operate entirely or partially according to an absorption principle, comprising:

forming a predetermined amount of a loose bundle of individual elements of a sound absorbing material; and roughly shaping the loose bundle in an assembly shaping unit corresponding to an intended shape of the muffler insert, whereby the loose bundle is fixed into a shaped composite in the shape corresponding to the assembly shaping unit, in such a way that the fixed shape can be handled without the individual elements loosening until assembly for the specified use of the muffler insert, the fixing being at least partially released during the specific use as the muffler insert.

2. The process as set forth in claim 1, wherein the release of the shaped composite takes place as a result of a temperature effect.

3. The process as set forth in claim 1, wherein the shaped composite is made in tubular form.

4. The process as set forth in claim 1, wherein the loose bundle is made without a binding agent.

5. The process as set forth in claim 1, wherein the sound absorbing material comprises at least partially textured E-glass-yarn.

6. The process as set forth in claim 1, wherein the sound absorbing material at least partially includes mineral wool.

7. The process as set forth in claim 1, wherein the loose bundle is weighed for forming a predetermined amount.

8. The process as set forth in claim 1, wherein a covering for the loose bundle is made out of a flat material formed of strips in order to form a shaped composite.

9. The process as set forth in claim 8, wherein the flat material comprises at least partially of textured E-glass-yarn.

10. The process as set forth in claim 1, wherein the fixing takes place at least partially by sewing.

11. The process as set forth in claim 1, wherein the fixing takes place alt least partially by gluing.

12. The process as set forth in claim 1, wherein the assembly shaping unit is wound around a mandrel in order to form a tubular shaped composite.

13. The process as set forth in claim 12, wherein the assembly form element is inserted into a pipe.

14. A muffler insert, comprising:

a predetermined amount of a loose bundle of individual elements of a sound absorbing material, wherein the individual elements are bound together in a fixed shape using an outer member disposed about the loose bundle so as to maintain the fixed shape, whereby the outer member is adapted to at least partially separate during use of the muffler insert to enable distribution of the individual elements.

15. The muffler insert as set forth in claim 14, wherein the muffler insert forms a shaped composite which separates along the outer member by action of heat.

16. The muffler insert as set forth in claim 14, wherein the individual elements are fixed in shape by disposing the individual elements in a covering which is sewn along a seam to securely hold the individual elements therein.

17. The muffler insert as set forth in claim 16, wherein the covering comprises a fabric of textured E-glass-yarn.

18. The muffler insert as set forth in claim 16, wherein the covering comprises a predetermined amount of individual elements.

* * * * *